US005848538A

United States Patent [19]

Tischer

[11] Patent Number: 5,848,538

[45] Date of Patent: Dec. 15, 1998

[54] OIL AND REFRIGERANT PUMP FOR CENTRIFUGAL CHILLER

[75] Inventor: James C. Tischer, La Crescent, Minn.

[73] Assignee: American Standard Inc., Piscataway, N.J.

[21] Appl. No.: 965,495

[22] Filed: Nov. 6, 1997

[51] Int. Cl.[6] ..... F25B 43/02

[52] U.S. Cl. ..... 62/468; 417/199.1; 416/88

[58] Field of Search ..... 62/468, 470, 84; 417/199.1, 201; 418/88

[56] References Cited

U.S. PATENT DOCUMENTS

| | | | |
|---|---|---|---|
| 2,814,254 | 11/1957 | Litzenberg | 103/87 |
| 2,830,755 | 4/1958 | Anderson | 230/132 |
| 3,149,478 | 9/1964 | Anderson et al. | 62/469 |
| 3,183,838 | 5/1965 | Englesson | 103/4 |
| 3,195,468 | 7/1965 | Bood | 103/87 |
| 3,203,352 | 8/1965 | Schafranek | 103/87 |
| 3,389,569 | 6/1968 | Endress | 62/84 |
| 3,606,581 | 9/1971 | Sjotun | 417/45 |
| 3,645,112 | 2/1972 | Mount et al. | 62/505 |
| 3,838,581 | 10/1974 | Endress | 62/468 |
| 4,399,663 | 8/1983 | Hesler | 62/193 |
| 4,404,812 | 9/1983 | Zinsmeyer | 62/84 |
| 4,419,865 | 12/1983 | Szymaszek | 62/193 |
| 5,182,919 | 2/1993 | Fujiwara | 62/193 |

FOREIGN PATENT DOCUMENTS

| | | | |
|---|---|---|---|
| 625 343 | 7/1934 | Germany | 62/470 |

*Primary Examiner*—John M. Sollecito
*Attorney, Agent, or Firm*—William J. Beres; William O'Driscoll; Peter D. Ferguson

[57] ABSTRACT

A single motor drives both oil and refrigerant pumps in a refrigeration chiller, the motor and oil pump being disposed in the chiller's oil supply tank and the refrigerant pump being disposed exterior thereof. The refrigerant pump pumps liquid refrigerant to the chiller's compressor section so as to cool the motor by which the compressor is driven while the oil pump pumps oil to chiller locations that require lubrication when the chiller is in operation.

13 Claims, 2 Drawing Sheets

OIL AND REFRIGERANT PUMP FOR CENTRIFUGAL CHILLER

BACKGROUND OF THE INVENTION

The present invention relates to the lubrication of surfaces that require lubrication in a refrigeration chiller when the chiller is in operation and to the cooling, by system refrigerant, of the motor by which the compressor of such a chiller is driven. More particularly, the present invention relates to combined oil and refrigerant pump apparatus that ensures the delivery, under all operating conditions, of both lubricant and liquid refrigerant to the locations at which they are needed in a refrigeration chiller that employs a low pressure refrigerant.

Refrigeration chiller components include a compressor, a condenser, a metering device and an evaporator, the compressor compressing a refrigerant gas and delivering it, at relatively high pressure and temperature, to the chiller's condenser. The relatively high pressure, gaseous refrigerant delivered to the condenser rejects much of its heat content and condenses to liquid form in a heat exchange relationship with a heat exchange medium flowing therethrough.

Condensed, cooled liquid refrigerant next passes from the condenser to and through the metering device which reduces the pressure of the refrigerant and further cools it by a process of expansion. Such relatively cool refrigerant is then delivered to the system evaporator where it is heated and vaporizes in a heat exchange relationship with a liquid, such as water, flowing therethrough. The vaporized refrigerant then returns to the compressor and the liquid which has been cooled or "chilled" in the evaporator flows to a heat load in a building or in an industrial process application that requires cooling.

The compressor portion of a chiller typically includes both a compressor and a motor by which the compressor is driven. Such motors, in most if not all chiller applications, require cooling in operation and have often, in the past, been cooled by system refrigerant. In many chiller designs, gaseous refrigerant has been sourced upstream or downstream of the compressor for such purposes. In other designs, compressor drive motors have been cooled by liquid refrigerant sourced from a location within the chiller.

Chiller compressor drive motor cooling arrangements and chiller lubrication systems have, historically, been discrete from each other. In many cases, however, operation of the systems by which lubricant and motor cooling fluid were delivered to the locations of their use was predicated on the existence of a sufficiently high differential pressure within the chiller by which to drive oil or refrigerant from a relatively higher pressure source location to the relatively lower pressure location of their use in the chiller for such purposes.

The chemical constituencies and operating characteristics of refrigerants used in chillers have changed over the years, primarily as a result of environmental considerations, and the use of so-called "low pressure" refrigerants, such as HCFC 123, has become common in the past decade. These refrigerants are such that under certain chiller operating conditions the temperature and pressure existing in the system condenser approach those existing in the evaporator. As such, a sufficiently high pressure differential between the system evaporator and system condenser cannot be counted upon to exist under all chiller operating conditions to ensure the continuous availability of a pressure that can reliably be used to drive oil from the chiller's oil supply tank to chiller surfaces that require lubrication. Nor can such a reliably high pressure differential be counted upon to exist to ensure the delivery of refrigerant from a first chiller location to the motor which drives the system's compressor for purposes of cooling that motor. Both, once again, were common past practices that were permitted by the use of "higher pressure" refrigerants than are used today.

In view of the above-described circumstances, the present invention seeks to advantageously incorporate aspects of both the lubrication system and motor cooling system in a refrigeration chiller in which a low pressure refrigerant is used to ensure, under all chiller operating conditions, the delivery of lubricant and refrigerant to the locations of their use for lubrication and motor cooling purposes.

SUMMARY OF THE INVENTION

It is an object of the present invention to provide for lubrication and compressor drive motor cooling in a refrigeration chiller.

It is another object of the present invention to provide for the delivery of oil and liquid refrigerant to the locations of their use within a refrigeration system by the use of apparatus common to both purposes.

It is still another object of the present invention to provide apparatus for pumping both lubricant and liquid refrigerant in a refrigeration chiller which is unaffected by chiller operating conditions.

It is a further object of the present invention to provide the means by which to deliver both oil for lubrication purposes and liquid refrigerant for compressor drive motor cooling purposes by the use of liquid refrigerant and lubricant pumping apparatus which is driven by a single motor and drive shaft in a refrigeration chiller that employs a low pressure refrigerant.

These and other objects of the present invention, which will be appreciated by reference to the attached drawing figures and the following Description of the Preferred Embodiment, are accomplished by combined refrigerant/lubricant pump apparatus in a refrigeration chiller, the pumps being driven by a common drive shaft which is driven by a single electric motor disposed, along with the lubricant pump, in the chiller's oil supply tank. The use of electric motor driven pumps by which to deliver oil and liquid refrigerant for lubrication and compressor drive motor cooling purposes assures the continuous availability of both lubricant and liquid refrigerant for those purposes irrespective of the conditions under which the chiller operates. The refrigerant pumping mechanism is driven by the same drive shaft as the lubricant pump but is disposed exterior of the oil supply tank in which the motor and lubricant pump are disposed. By the integral mounting of both the refrigerant pump and lubricant pump to a single drive shaft driven by a single electric motor, the lubrication and compressor drive motor cooling functions are reliably carried out in a low pressure refrigerant environment by apparatus which employs a minimum number of parts and is of relatively low cost.

DESCRIPTION OF THE DRAWING FIGURES

DESCRIPTION OF THE PREFERRED EMBODIMENT

Figure 1A:
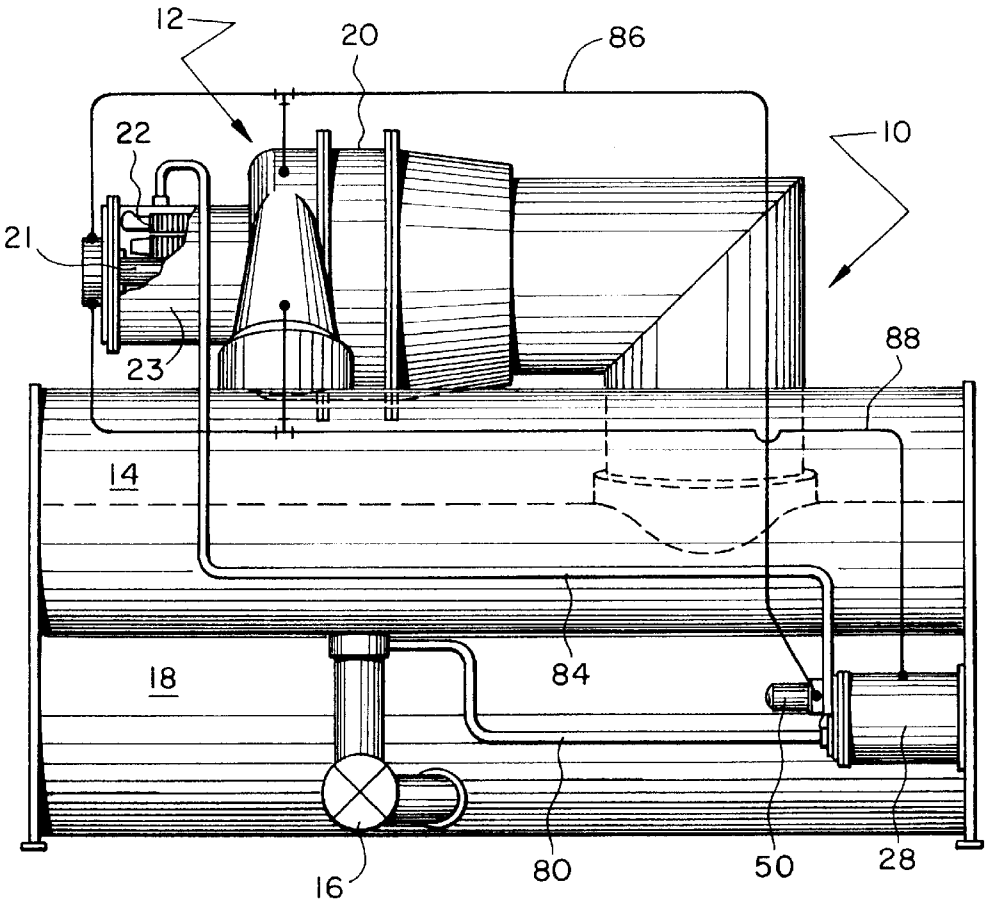
FIG. 1A and 1B are side and end views of a refrigeration chiller in which the primary component parts thereof are illustrated.
Figure 1B:
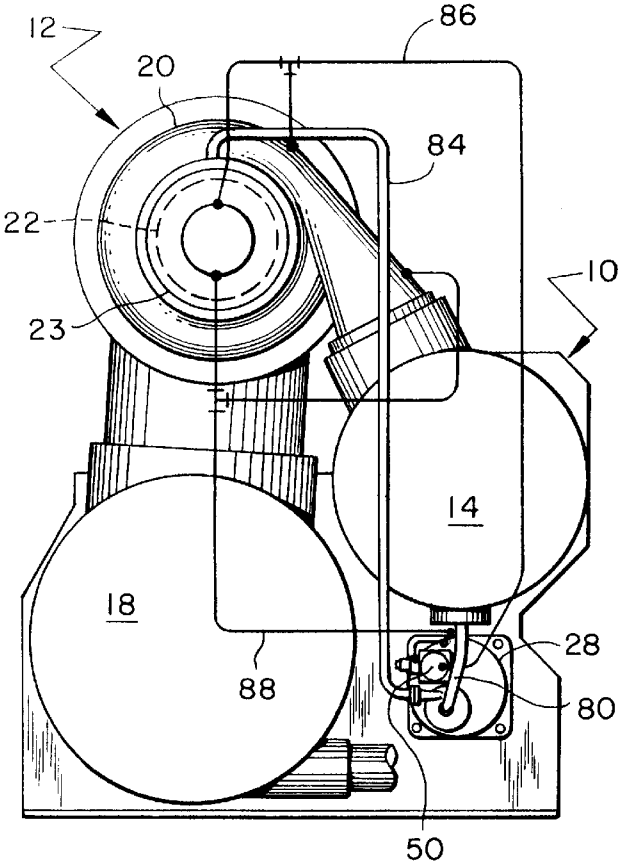

Referring initially to FIGS. 1A and 1B, the major components of refrigeration chiller 10 are a compressor portion 12, a condenser 14, a metering device 16 and an evaporator 18. Compressor portion 12 of chiller 10 is comprised of a centrifugal compressor 20 which is driven, through a drive shaft 21, by an electric motor 22 which is encased in a motor housing 23.

In operation, the driving of centrifugal compressor 20 by compressor drive motor 22 causes a relatively low pressure refrigerant gas, such as the refrigerant commonly know as HCFC 123, to be drawn from evaporator 18 into the compressor. By a process of centrifugal compression, the gas drawn from evaporator 18 is compressed and discharged from centrifugal compressor 20, in a heated, relatively high pressure state, to condenser 14.

The relatively high pressure, high temperature refrigerant gas delivered to condenser 14 transfers heat to a cooling medium, such as water, flowing therethrough. The heat exchange medium, if water, is typically sourced from a municipal water supply or a cooling tower. The refrigerant condenses in the course of rejecting its heat content to the cooling medium and next flows to metering device 16. Device 16 further reduces the pressure and temperature of the condensed refrigerant by a process of expansion.

The now relatively cool, relatively low pressure refrigerant, which is in two-phase but primarily liquid form after passage through the expansion device, next flows to evaporator 18 where it undergoes heat exchange with a fluid flowing therethrough, most typically, once again, water. In this heat exchange process, the relatively more warm fluid flowing through the evaporator rejects its heat content to the relatively cooler liquid refrigerant causing the refrigerant to vaporize. The now cooled or "chilled" fluid then flows from the evaporator to a location, such as a space in a building or a location in an industrial process, where chilled water is used for cooling purposes. The heated, now vaporized, relatively low pressure refrigerant is drawn back into compressor 20 to start the process anew.

In refrigeration chillers that employ certain so-called low pressure refrigerants, the pressure differential between the chiller evaporator and the chiller condenser is not as high, under all chiller operating conditions, as was the case in earlier chillers in which relatively higher pressure refrigerants were used. It is to be noted that some of these relatively higher pressure refrigerants, such as CFC 11, were themselves considered to be low pressure refrigerants during the period of their use.

Where such relatively higher pressure refrigerants were previously used, a relatively large pressure differential between the evaporator and condenser of a chiller could be counted upon to develop and continue to exist under all chiller operating conditions. In some chiller designs, particularly those employing a screw rather than centrifugal compressor, that made it convenient to use that differential pressure for purposes such as driving lubricant from the chiller's oil supply tank to lower pressure chiller locations requiring lubrication and/or to drive liquid refrigerant from a first location in the chiller to the lower pressure location of the chiller's compressor drive motor for drive motor cooling purposes.

Figure 2:
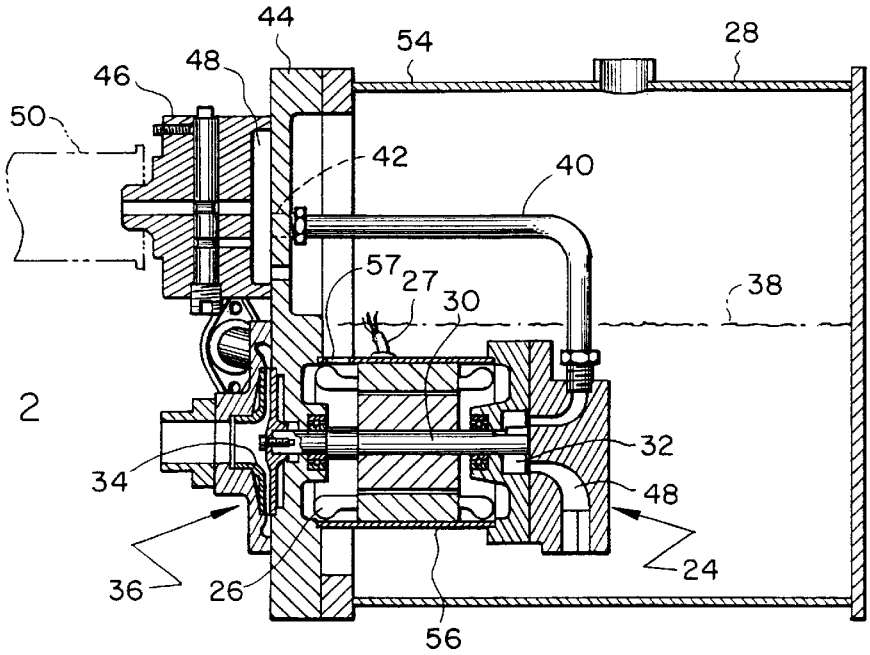
FIG. 2 is a cross-sectional view of the combined lubricant and refrigerant pumping apparatus of the present invention as installed within the oil supply tank of the chiller illustrated in FIG. 1A and 1B.
Figure 3:
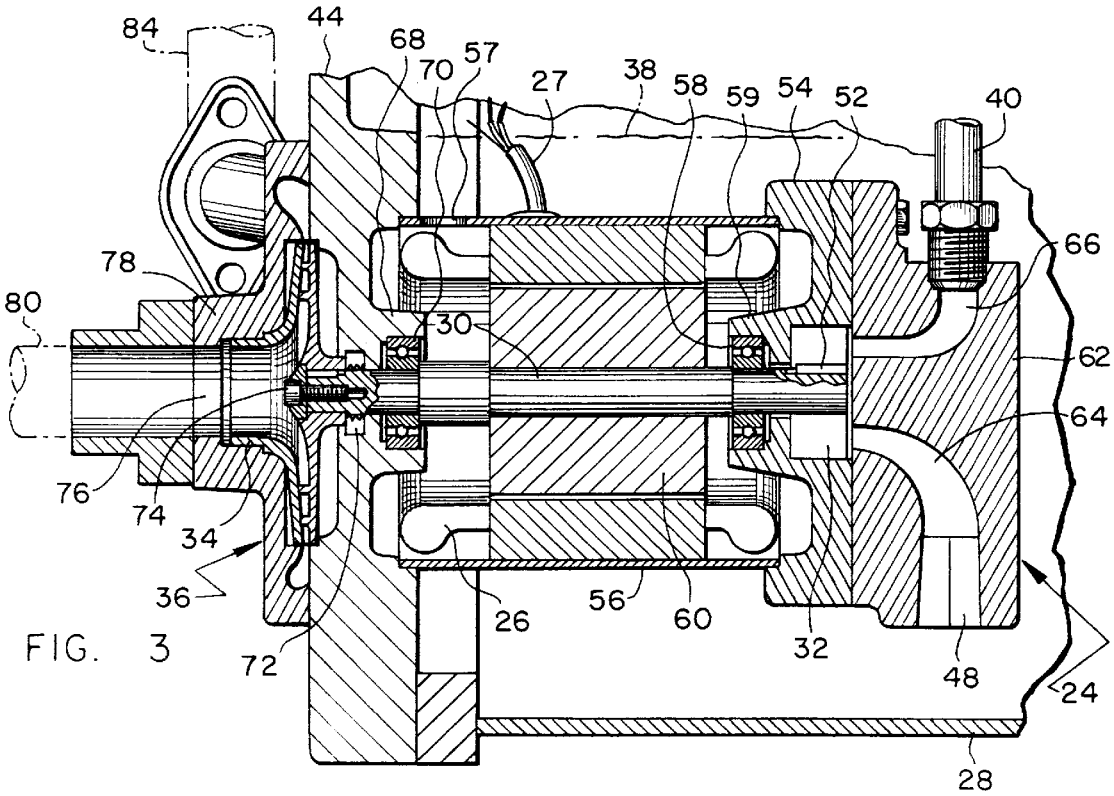
FIG. 3 is an enlarged view of the lubricant/refrigerant pumping apparatus portion of FIG. 2.

Referring additionally now to FIGS. 2 and 3, lubricant pump 24, in the chiller of the present invention, and electric motor 26 which drives it are disposed in the chiller's oil supply tank 28. Motor 26, to which power is delivered through electrical leads 27, drives a shaft 30 which, in turn, drives lubricant pumping element 32. Shaft 30 is likewise coupled to impeller 34 which is the pumping element of centrifugal refrigerant pump 36 and is mounted exterior of oil supply tank 28.

Lubricant is pumped by pump 24 through a pipe 40 disposed internal of oil supply tank 28 that communicates between lubricant pump 24 and an aperture 42 in the head wall 44 of the oil supply tank. A lubricant manifold 46, such as the one which is the subject of U.S. Pat. No. 5,675,978, assigned to the assignee of the present invention, is mounted to oil supply tank head wall 44 and has an intake chamber 48 into which lubricant is pumped by the operation of lubricant pump 24.

Lubricant manifold 46 is positionable to accomplish various lubrication related functions within the chiller, such as providing a set-up for the normal flow of lubricant to chiller bearings and surfaces, a set-up allowing for the change of the chiller oil supply while isolating the chiller's refrigerant charge, a set-up to allow the sampling of the chiller's oil supply for chemical analysis purposes and a set-up allowing for the change of oil filter 50 while isolating the chiller's oil supply. Among the bearings and surfaces to which lubricant must be provided in chiller 10 are the bearings which rotatably support the drive shaft 21 which connects compressor drive motor 22 and centrifugal compressor 20.

Referring primarily now to FIG. 3, it will be seen that in the preferred embodiment of the present invention lubricant pump element 32 is secured by key 52 to shaft 30 for rotation therewith and is disposed in lubricant pump element housing 54. Lubricant pump element housing 54 is attached to and supported by motor housing 56 which is, in turn, connected to and supported by head wall 44 of oil supply tank 28. It is to be noted that disposal of pump motor 26 in oil supply tank 28 brings with it the advantage of its being able to reject the heat it develops in operation to the oil which surrounds it. Motor 26 is, in fact, flooded with oil which is admitted into motor housing 56 through an aperture 57 therein.

Lubricant pump element housing 54 also houses bearing 58 in a bearing housing 59 integrally defined by it. Bearing 58 rotatably supports shaft 30 and rotor 60 of motor 26 at a first end. Lubricant pump port plate 62 is attached to and supported by lubricant pump element housing 54 and defines the flow path 64 by which oil is delivered from the interior of supply tank 28 to oil pump element 32 and the flow path 66 by which oil is delivered from oil pump element 32 to pipe 40.

Motor housing 56, as noted above, is mounted at its opposite end to oil supply tank head wall 44. Head wall 44, in the preferred embodiment, integrally defines a bearing housing 68 in which bearing 70 is disposed. Bearing 70 rotatably supports drive shaft 30 and motor rotor 60 at the ends thereof which are opposite the ends on which they are supported by bearing 58. Shaft 30 extends through and past bearing 70 and penetrates oil supply tank head wall 44. A portion of shaft 30 is surrounded by a seal 72 ensconced in oil supply tank head wall 44.

Refrigerant pumping impeller 34 is connected to shaft 30 for rotation therewith by a screw 74 which threads into an end face of shaft 30. Impeller 34 is disposed in impeller cavity 76 which is defined in volute housing 78. Volute housing 78 is mounted to the exterior surface of oil supply tank head wall 44. Seal 72 acts as a seal between impeller cavity 76 through which liquid refrigerant flows and the interior of oil supply tank 28. Because refrigerant pump 36 is of a centrifugal type it does not employ contacting parts, such as gear or other types of positive displacement pumps might and, as such, needs no lubrication.

Referring once again to all of the drawing figures, refrigerant pump impeller cavity 76 is in flow communication on an intake side with condenser 14 of chiller 10 via intake piping 80 and is likewise in flow communication with the interior of compressor drive motor housing 23 via discharge piping 84. By the operation of pump motor 26, both lubricant pumping element 32 and refrigerant pumping impeller 34 are driven. As a result, lubricant is pumped out of oil supply tank 28, through piping 40, lubricant manifold 46 and lubricant piping 86 to various locations within chiller 10 that require lubrication, such lubricant being returned to supply tank 28 via return piping 88. Simultaneously and by operation of the same apparatus, liquid refrigerant is pumped from chiller condenser 14 into the interior of compressor drive motor is housing 23 where it is delivered into heat exchange contact with compressor drive motor 22 so as to cool that motor. By the combined driving of both a liquid refrigerant pump and a oil pump by a single motor on a single drive shaft, the delivery of liquid refrigerant for compressor drive motor cooling purposes and the delivery of oil for lubrication purposes is reliably accomplished under all operating conditions within centrifugal chiller 10, which employs a low pressure refrigerant, all in a manner which reduces the number of parts associated with those functions as well as the costs involved in doing so.

While the present invention has been described in terms of a preferred embodiment, it will be appreciated that many modifications thereto are contemplated and within the scope of the present invention which is more broadly claimed as follows.

What is claimed is:

1. A refrigeration chiller comprising:

a compressor;

a motor for driving said compressor, said motor being disposed in a housing;

a condenser for receiving refrigerant from said compressor;

a metering device, said metering device receiving refrigerant from said condenser;

an evaporator, said evaporator receiving refrigerant from said metering device and being connected for refrigerant flow to said compressor;

a lubricant supply tank; and commonly driven means for pumping both lubricant from said lubricant supply tank to a location in said chiller that requires lubrication when said chiller is in operation and liquid refrigerant from said condenser to said motor so as to cool said motor when said chiller is in operation.

2. The refrigeration chiller according to claim 1 wherein said commonly driven pumping means includes both a refrigerant pumping element and a lubricant pumping element, said lubricant pumping element being disposed in said lubricant supply tank and said refrigerant pumping element being disposed exterior thereof.

3. The refrigeration chiller according to claim 2 wherein said commonly driven pumping means includes a drive shaft, said drive shaft driving both said lubricant pumping element and said refrigerant pumping element.

4. The refrigeration chiller according to claim 3 wherein said drive shaft is driven by a pump motor, said pump motor being an electric motor disposed internal of said lubricant supply tank, said pump motor including a stator and a rotor, said rotor being mounted to said drive shaft for rotation therewith.

5. The refrigeration chiller according to claim 4 wherein said drive shaft penetrates a wall of said lubricant supply tank.

6. The refrigeration chiller according to claim 5 wherein said refrigerant pumping element is an impeller and further comprising a housing for said impeller, said impeller and said housing combining to form a centrifugal pumping mechanism, said centrifugal refrigerant pumping mechanism being connected for flow on an inlet side to said condenser and being connected on an outlet side to the interior of said housing in which said motor for driving said compressor is disposed.

7. The refrigeration chiller according to claim 6 further comprising a pump motor housing, said pump motor being disposed in said pump motor housing, said pump motor housing being mounted to said wall of said lubricant supply tank.

8. The refrigeration chiller according to claim 7 wherein said wall of said lubricant supply tank defines a bearing housing and further comprising a first bearing, said first bearing being disposed in said bearing housing defined by said wall of said lubricant supply tank, said drive shaft being rotatably carried in said first bearing.

9. The refrigeration chiller according to claim 8 further comprising a housing for said lubricant pumping element, said housing for said lubricant pumping element being mounted to said pump motor housing and defining a bearing housing, a second bearing being disposed in said bearing housing defined by said housing for said lubricant pumping element, said drive shaft being rotatably carried in said second bearing.

10. The refrigeration chiller according to claim 9 wherein said housing for said impeller is mounted to an exterior wall of said lubricant supply tank.

11. The refrigeration chiller according to claim 10 wherein said pump motor housing is disposed below the level of lubricant in said lubricant supply tank, said pump motor housing being flooded by said lubricant.

12. The refrigeration chiller according to claim 11 further comprising piping connecting said lubricant pumping element to a location in said chiller that requires lubrication when said chiller is in operation, a portion of said piping being disposed internal of said lubricant supply tank and a portion of said piping being disposed exterior thereof.

13. The refrigeration chiller according to claim 12 further comprising a lubricant pump plate, said lubricant pump plate being attached to said housing for said lubricant pumping element, said lubricant pump plate defining an inlet in flow communication with lubricant in said lubricant supply tank and an outlet in flow communication with said piping.

* * * * *